US005813617A

United States Patent [19]

Thoma

[11] Patent Number: 5,813,617

[45] Date of Patent: Sep. 29, 1998

[54] DUAL FEED WOOD CHIP DESTRUCTURING DEVICE

[75] Inventor: Eduard J. Thoma, Powell River, Canada

[73] Assignee: Beloit Technologies, Inc., Wilimington, Del.

[21] Appl. No.: 820,803

[22] Filed: Mar. 19, 1997

[51] Int. Cl.[6] ..... B02C 4/28

[52] U.S. Cl. ..... 241/135; 241/144; 241/235

[58] Field of Search ..... 241/159, 235, 241/236, 135, 144, 221

[56] References Cited

U.S. PATENT DOCUMENTS

| | | | |
|---|---|---|---|
| 1,079,465 | 11/1913 | Bausman | 241/135 |
| 1,702,341 | 2/1929 | Gillespie | 241/135 |
| 2,652,984 | 9/1953 | Dodds | 241/135 |
| 4,082,228 | 4/1978 | Paterson et al. | 241/135 |
| 4,508,029 | 4/1985 | Malone | 241/135 |
| 4,779,807 | 10/1988 | High et al. | 241/135 |
| 5,385,309 | 1/1995 | Bielagus | 241/235 |

OTHER PUBLICATIONS

"DynaYield Chip Conditioner™. . . cost effective overthick chip processing," by Rader Companies, A Division of Beloit Corporation, May 1993, 6 pages.

*Primary Examiner*—Mark Rosenbaum
*Attorney, Agent, or Firm*—Lathrop & Clark

[57] ABSTRACT

A chip destructuring system combines two chip destructuring devices which are positioned back to back and fed from a single flow of chips. The chips flow into a splitter which directs the chips into a right handed and left handed auger mounted on a common shaft. The right handed auger meters wood chips into the nip of a first destructuring device, while the left handed auger meters chips into the nip of a second destructuring device. A pair of baffles hinged at an apex form the splitter. Each baffle makes up one side of the splitter and controls the flow of chips to either the right or the left augers. The baffles may also be adjusted to hang vertically and allow the flow of chips to bypass the augers and the chip destructuring devices.

10 Claims, 6 Drawing Sheets

DUAL FEED WOOD CHIP DESTRUCTURING DEVICE

FIELD OF THE INVENTION

The present invention relates to an apparatus for treating wood chips to enhance liquor penetration in subsequent pulping operations. More particularly, the present invention relates to a destructuring apparatus in which chips are passed between closely spaced rolls whose surfaces are aggressively contoured for causing chips to be cracked by compressive forces.

BACKGROUND OF THE INVENTION

In the production of paper from wood fibers, the wood fibers must be freed from the raw wood. In one widely used method, this is accomplished by cooking the wood fibers in a solution until the material holding the fibers together, lignin, is dissolved. In order to achieve rapid and uniform digestion by the cooking liquor, the wood, after debarking, is passed through a chipper which reduces the raw wood to chips on the order of one inch to four inches long. The chipper, however, tends to produce a large percentage of over-thick chips which, after separation by a screen, must normally be reprocessed through a slicer to reduce them to the desired thickness. This reprocessing through a slicer has the undesirable effect of creating excessive sawdust and pins. The production of sawdust and pins reduces the overall yield of fiber from a given amount of raw wood. Because the cost of the raw wood is a major contributor to the cost of paper produced, reslicing the oversized chips incurs a considerable cost.

A recently commercialized alternative to reslicing over-thick wood chips is a process known as "destructuring" the chips. In destructuring, the chips are fed through opposed rollers which compress the chips as they pass through the nip of the rollers. The compression of the chip results in longitudinal fractures along the grain of the wood. The cracks induced in the chips allow the cooking liquor to penetrate the interior of the chip, thus effectively reducing the chip's thickness. Such a chip destructuring device is disclosed in U.S. Pat. No. 5,385,309 to Bielagus which is incorporated herein by reference.

Commercial chip destructuring devices have achieved considerable success in providing a better means for processing chips. However, practical considerations limit the size of a chip destructuring device. The forces generated between the opposed rolls are considerable and thus lengthening the rolls much beyond about eight feet is not practical because of bending of the rolls under the applied loads. Overcoming the deflection of the rolls is cost prohibitive. Additionally, the market for a chip destructuring device larger than currently available is relatively small, and thus does not justify developing a larger machine. On the other hand, simply setting up two streams of chips which feed two destructuring devices requires expensive duplication of conveying systems. Further, in many existing chip processing systems where it is desirable to retrofit chip destructuring into the chip processing, flow space is not available to process two flows of chips.

What is needed is a structure for combining destructuring devices to increase chip destructuring capacity with existing commercial equipment.

SUMMARY OF THE INVENTION

The chip destructuring system of this invention combines two destructuring devices which are positioned back to back and fed from a single flow of chips. The chips flow into a splitter which directs the chips into a right handed and left handed auger mounted on a common shaft. The right handed auger meters wood chips into the nip of a first destructuring device, while the left handed auger meters chips into the nip of a second destructuring device. The splitter has a pair of baffles which are hinged to a distribution housing and brought together at an apex support. Each baffle makes up one side of the splitter and controls the flow of chips to either the right handed or the left handed auger. If the baffles are positioned vertically, they allow the flow of chips to bypass the augers and the destructuring devices. By adjustment of one or both baffles, the flow of wood chips can be directed to one or both chip destructuring devices. Adjustment of the baffles can also bypass one or both of the chip destructuring devices.

It is a feature of the present invention to provide the capability of destructuring a larger stream of chips than is possible with a single chip destructuring device.

It is another feature of the present invention to provide a means for bypassing a stream of chips through a chip destructuring station.

Further objects, features and advantages of the invention will be apparent from the following detailed description when taken in conjunction with the accompanying drawings.

DESCRIPTION OF THE PREFERRED EMBODIMENT

Figure 1:
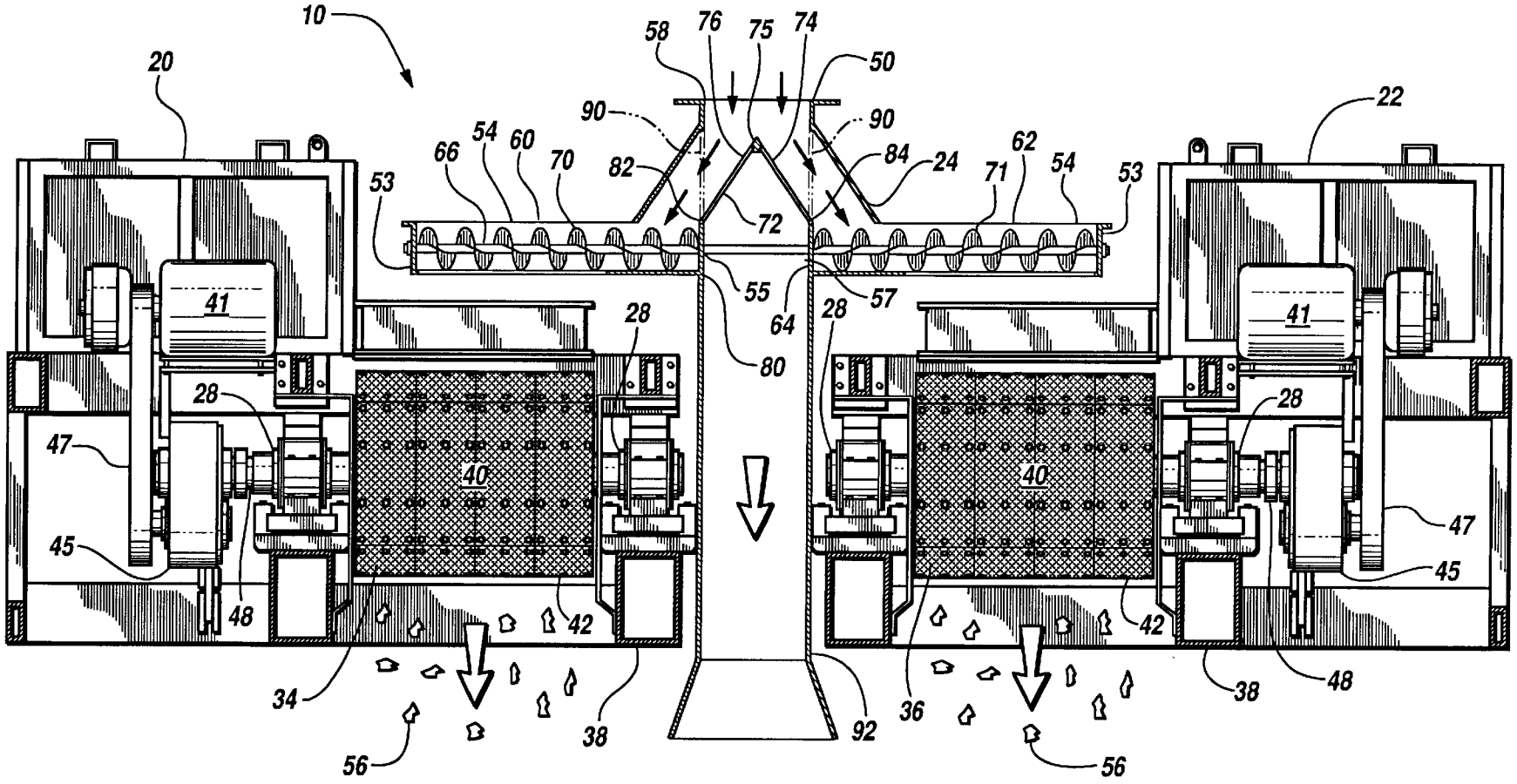
FIG. 1 is a side elevational view partly cutaway of two chip destructuring devices and a structure for joining and supplying chips to the chip destructuring devices, forming a chip destructuring system of this invention.

Referring more particularly to FIGS. 1-8, wherein like numbers refer to similar parts, a chip destructuring system 10 is shown in FIG. 1. The chip destructuring system has two chip destructuring devices 20, 22 arranged back to back and fed by a common chip distribution system 24. The chip destructuring devices 20, 22 are preferably similar to the DynaYield™ Chip Conditioner™ destructuring device available from Rader Companies of Portland, Oreg., a division of Beloit Corporation, of Beloit, Wisconsin. The chip destructuring devices available from Rader Companies have rolls which are four, six, or eight feet long. Roll lengths significantly greater than this are not practical because of deflection of the roll surfaces away from each other due to loading imposed on the rolls by the chips passing through the rolls.

Use of the various techniques for overcoming roll deflection, such as developed for use on papermaking machines, is not practical in view of the cost of such a machine. Further, comparatively few processors of chips require processing capability significantly beyond that available from a standard Rader chip destructuring apparatus.

Combining two chip destructuring devices 20, 22 with a chip distribution system 24 provides the high throughput chip conditioning system 10 needed by some chip processors without substantially greater cost and technical difficulties inherent in a larger chip destructuring device.

Figure 2:
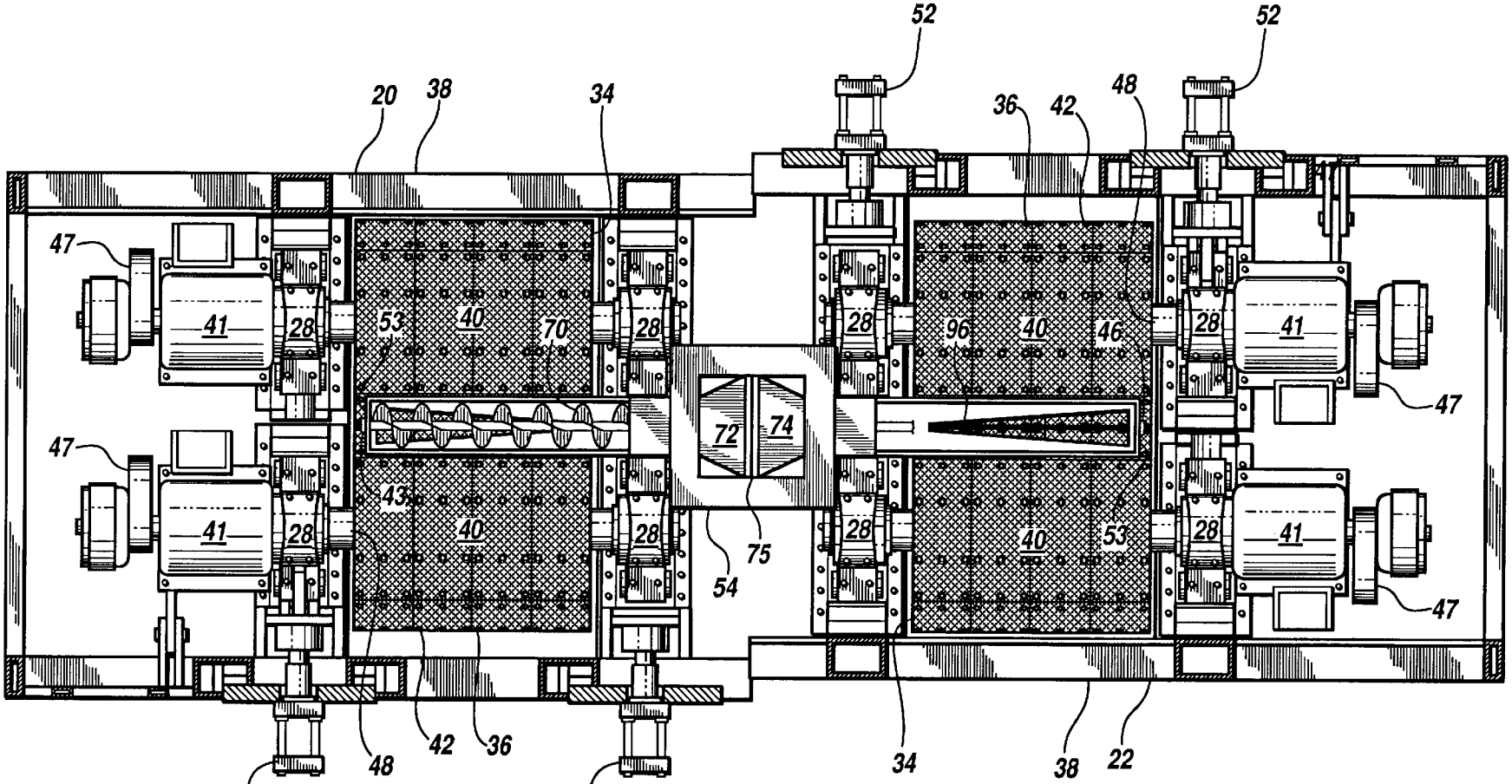
FIG. 2 is a plan view partly cutaway of the chip destructuring system of FIG. 1.

The chip destructuring devices 20, 22 shown in FIGS. 1 and 2 have first rolls 34 and second rolls 36 which are mounted for rotation by bearings 28 to the frames 38. The rolls 34, 36 have aggressively contoured surfaces 40. The surfaces, for convenience of manufacture and repair, are comprised of removable surface segments 42 mounted to inner roll shells (not shown). The rolls 34, 36 counter-rotate in spaced parallel relation to form nip lines 43, 46. The nip lines 43, 46 are substantially co-linear so that the nip line 43 if extended passes through the nip line 46.

The aggressive contoured surfaces of the rolls 34, 36 are preferably composed of pyramids which are arranged in circumferential rows to form the aggressive surfaces of the rolls 34, 36. In use, the pyramids cause the chips 56 to be fractured along the direction of the grain which is the direction of fiber orientation in the wood chips 56. The construction, operation, and shape of the pyramidal aggressive surfaces used on the chip destructuring devices 20, 22 are more fully explained in U.S. Pat. Nos. 4,953,795 and 5,385,309 which are incorporated herein by reference.

The chip destructuring devices 20, 22 have electric motors 41, which drive speed reducers 45 by matched V-belts 47. The speed reducers 45 are connected to the central drive shafts 48 of the rolls 34, 36.

The rolls 36, together with their bearings and speed reducer, are horizontally adjustable by means of hydraulic actuators 52. These control the width of the nip 43, 46 by moving the roll 36 in spaced parallel relation to the opposed roll 34. The hydraulic actuators 52 also allow the rolls 34, 36 to separate in response to a foreign object such as tramp metal and so decrease the likelihood of damage to the roll surfaces.

Figure 6:
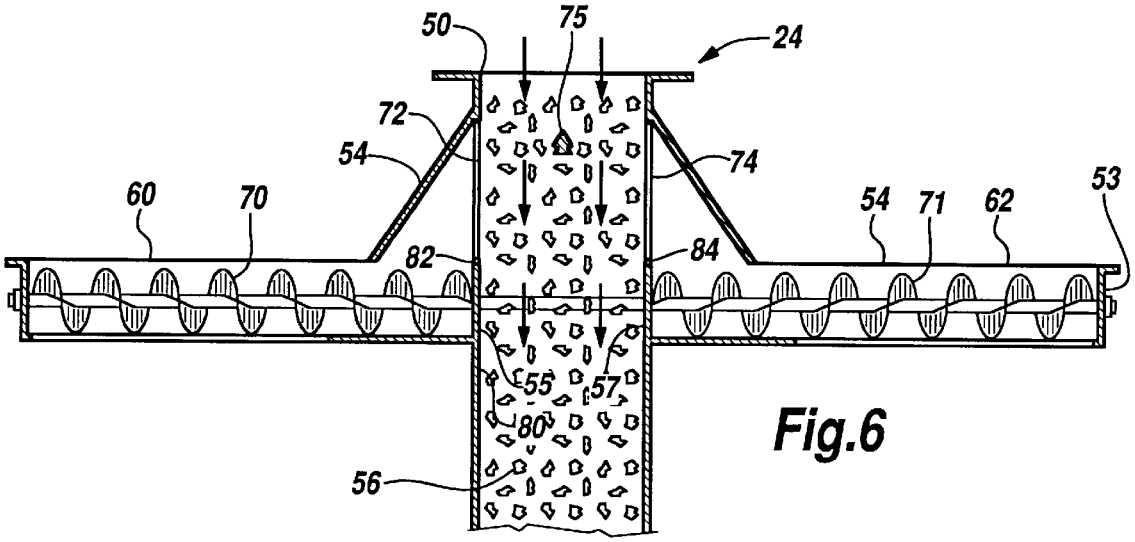
FIG. 6 is a fragmentary cross-sectional view of the chip distribution system of the chip destructuring system of FIG. 1 showing chips passing through a bypass.
Figure 7:
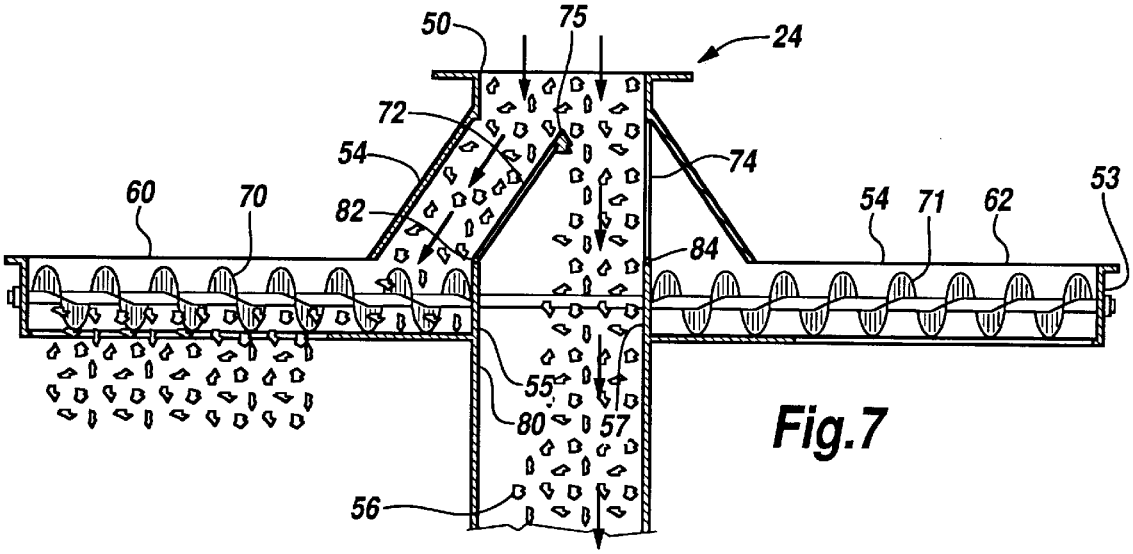
FIG. 7 is a partial cross-sectional view of the chip distribution system of FIG. 6 showing the chips bypassing one auger and flowing to the other auger.
Figure 8:
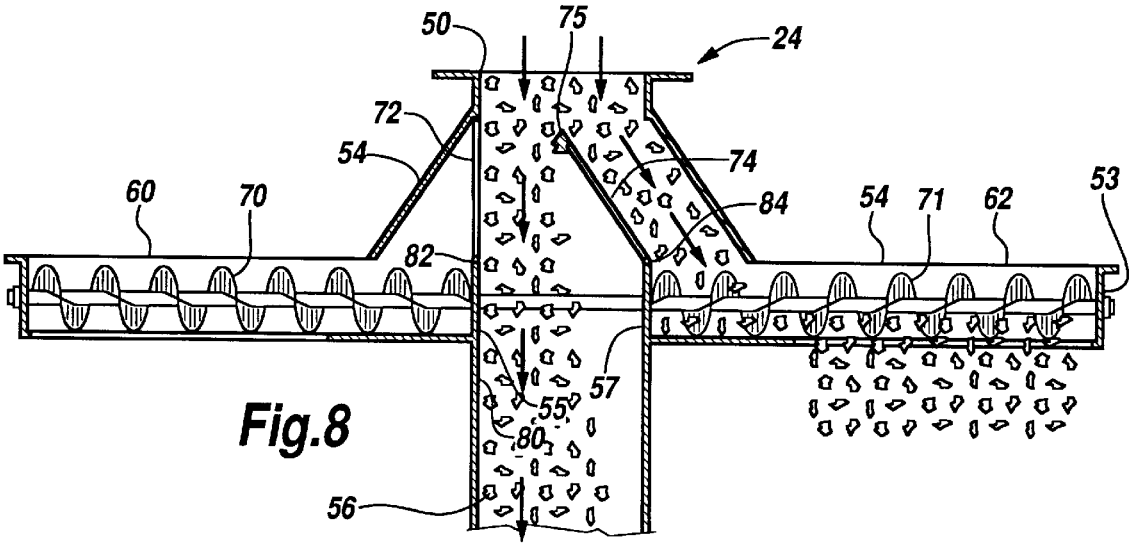
FIG. 8 is a partial cross-sectional view of the chip distribution system of FIG. 7 showing the auger being bypassed in an arrangement opposite to that shown in FIG. 7.

As best shown in FIG. 6-8, chips 56 to be processed are fed through a chip feed 50 which incorporates a distribution housing 54 mounted over the nip lines 43, 46 formed between the rolls 34, 36 which are shown in FIG. 2. The distribution housing 54 is located above the nip lines 43, 46 and is supplied with wood chips 56 through a wood chip receiving opening 58. A portion 60 of the housing 54 extends over the nip line 43 of the first destructuring device 20 and another portion 62 extends over the nip line 46 of the second destructuring device 22. A portion 64 of the housing 54 joins the outwardly extending portions 60, 62 and extends between the chip destructuring devices 20, 22.

A shaft 66 extends along the distribution housing 54. The shaft 66 is mounted for rotation within the housing 54 between end plates 53. Support plates 55, 57 support the shaft 66 on either side of, and form part of, a bypass opening 80. The support plates 55, 57 also form a support on which the baffles 72, 74 are mounted by hinges 82, 84.

Mounted about the shaft 66 is a right handed auger 70 positioned in the first portion 60 of the housing which extends over the first destructuring device 20. Opposite the right handed auger on the shaft 66 is a left handed auger 71 which is positioned in the second portion 62 of the housing 54 which extends over the second destructuring device 22. The shaft 66 is caused to rotate by a motor (not shown) so that wood chips delivered to the housing 54 through the chip receiving opening 58 are moved to the left and the right as shown in FIG. 1.

The pair of baffles 72, 74 is brought together at a support bar 75 to form a splitter 76 which divides a flow of wood chips 56 from a conveyor or chute (not shown). The splitter divides the flow of wood chips between the right handed auger 70 and the left handed auger 71.

The bypass opening 80 is formed beneath the shaft 66 in the portion 64 of the housing 54 located beneath the chip receiving opening 58. The baffles 72, 74 are movable about the hinges 82, 84 which join the baffles to the support plates 55, 57. Moving the baffles 72, 74 to a vertical position 90 as shown in FIG. 1 allows the chips to bypass the chip destructuring devices 20, 22 and pass through a bypass chute 92. If one of the destructuring devices 20, 22 becomes inoperative, a single baffle can be moved to the vertical position 90 and a portion of the wood chips bypassed through the chip destructuring devices. This bypassed flow can be sent to a chip stock pile as shown in FIG. 5.

The positions the baffles 72, 74 can assume are shown in FIGS. 1 and 6-8. FIG. 1 corresponds to the normal operation of the chip destructuring system 10 where a stream of chips 56 is split and supplied to both sets of destructuring rolls 34, 36. FIG. 6 illustrates completely bypassing the chip destructuring system 10 by allowing the chips 56 to pass through without being destructured. FIG. 7 illustrates splitting the flow of chips and allowing half the chips to bypass the destructuring system 10. FIG. 8 is similar to FIG. 7 only the position of the baffles 72, 74 have been reversed so that chips flow to the opposite chip conditioner.

As shown in FIG. 2, where the shaft 66 and the left handed auger 71 are cut away for illustrative purposes, trapezoidal slots 96 formed in the distribution housing underlie the augers so that the chips conveyed by the augers are evenly distributed along the nip lines 43, 46.

Figure 5:
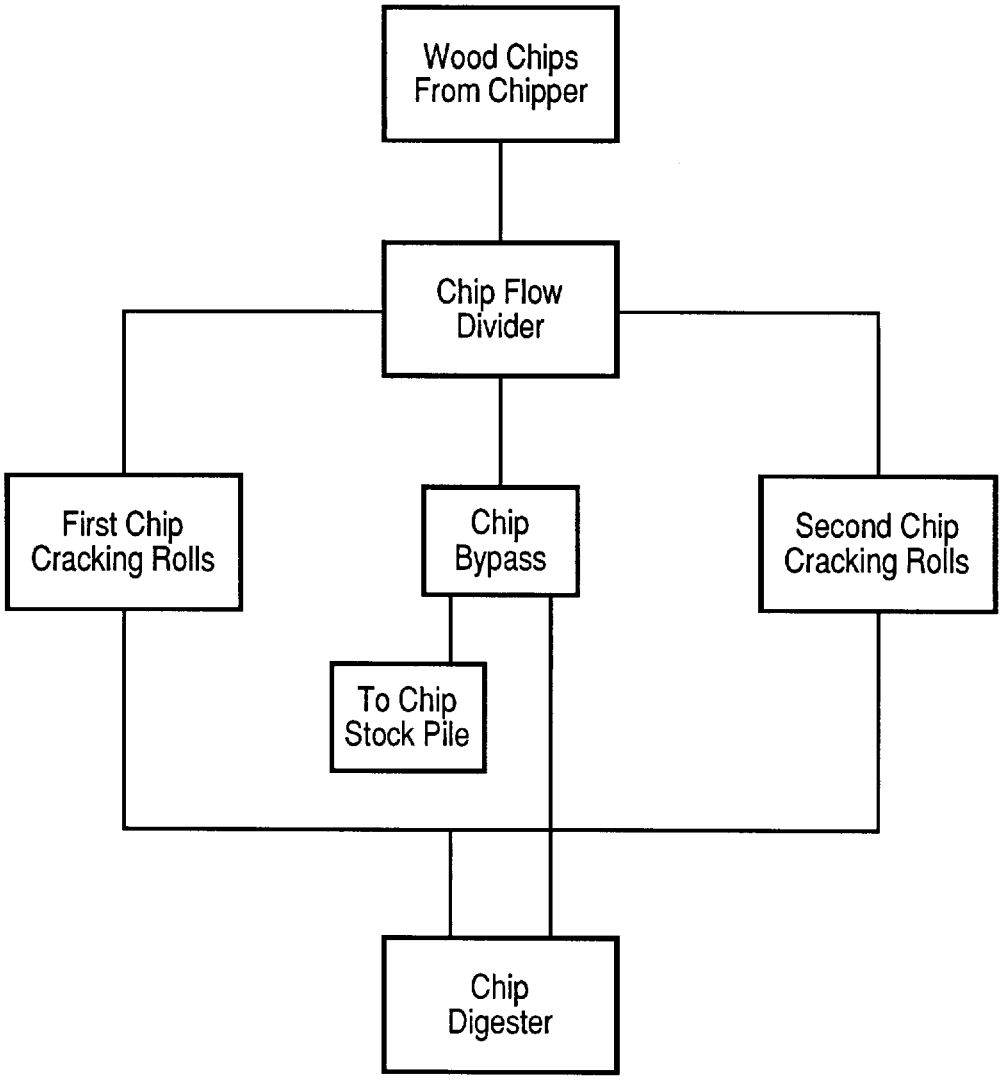
FIG. 5 is a block diagram of the flow of wood chips through the chip destructuring system of FIG. 1.

The flow diagram shown in FIG. 5 illustrates how the chip destructuring devices 20, 22 of FIGS. 1 and 2 are joined to form a system of greater chip destructuring capability without the need for providing two separate chip streams which can be prohibitively expensive. This attribute of the invention is particularly advantageous for implementation in an existing chip processing facility, where sufficient space may not be available to set up two separate chip streams.

The chip destructuring devices 20, 22 are spaced apart for a bypass chute 92 about three feet wide as shown in FIGS. 1 and 2. This provides space for bypass wood chips to flow between the chip destructuring devices and provides access to both destructuring devices.

FIG. 5 illustrates the process flow resulting from utilizing a destructuring system 10. Chips from a chipper flow in a single stream to the distribution system 24 which either splits the flow of wood chips or bypasses some or all of the chips through the destructuring system 10. If the destructuring system 10 is simply being taken out of the process, the wood chips will be sent to the chip digester. If a portion of the flow of chips cannot be processed because one of the destructuring devices is being maintained, that portion of the chips which would be processed by the destructuring apparatus being maintained is sent to a stock pile. If all the chips are split and processed by the chip destructuring rolls, the stream of destructuring chips are joined and sent to a chip digester.

Figure 3:
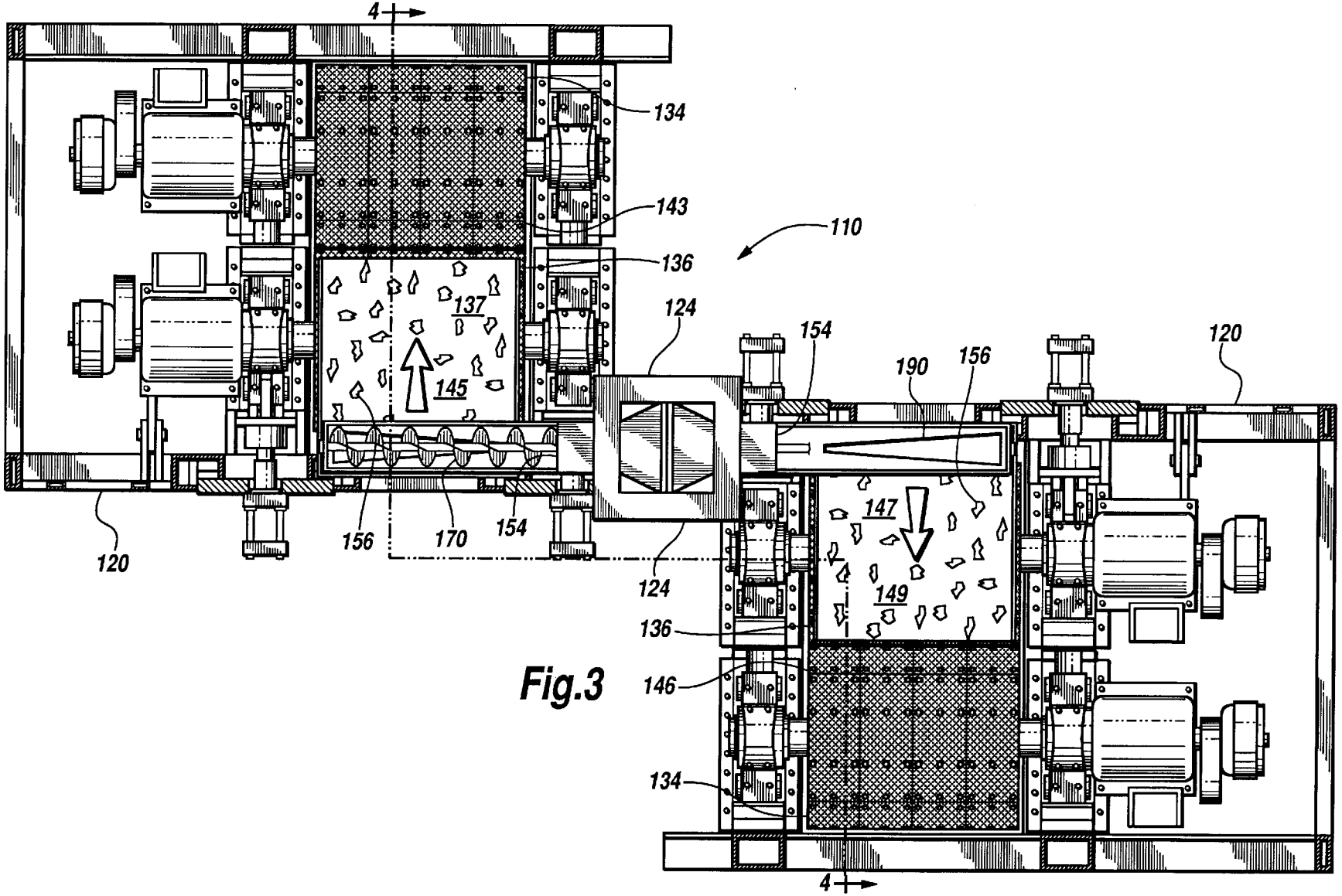
FIG. 3 is a plan view of an alternative embodiment of the chip destructuring system of this invention.
Figure 4:
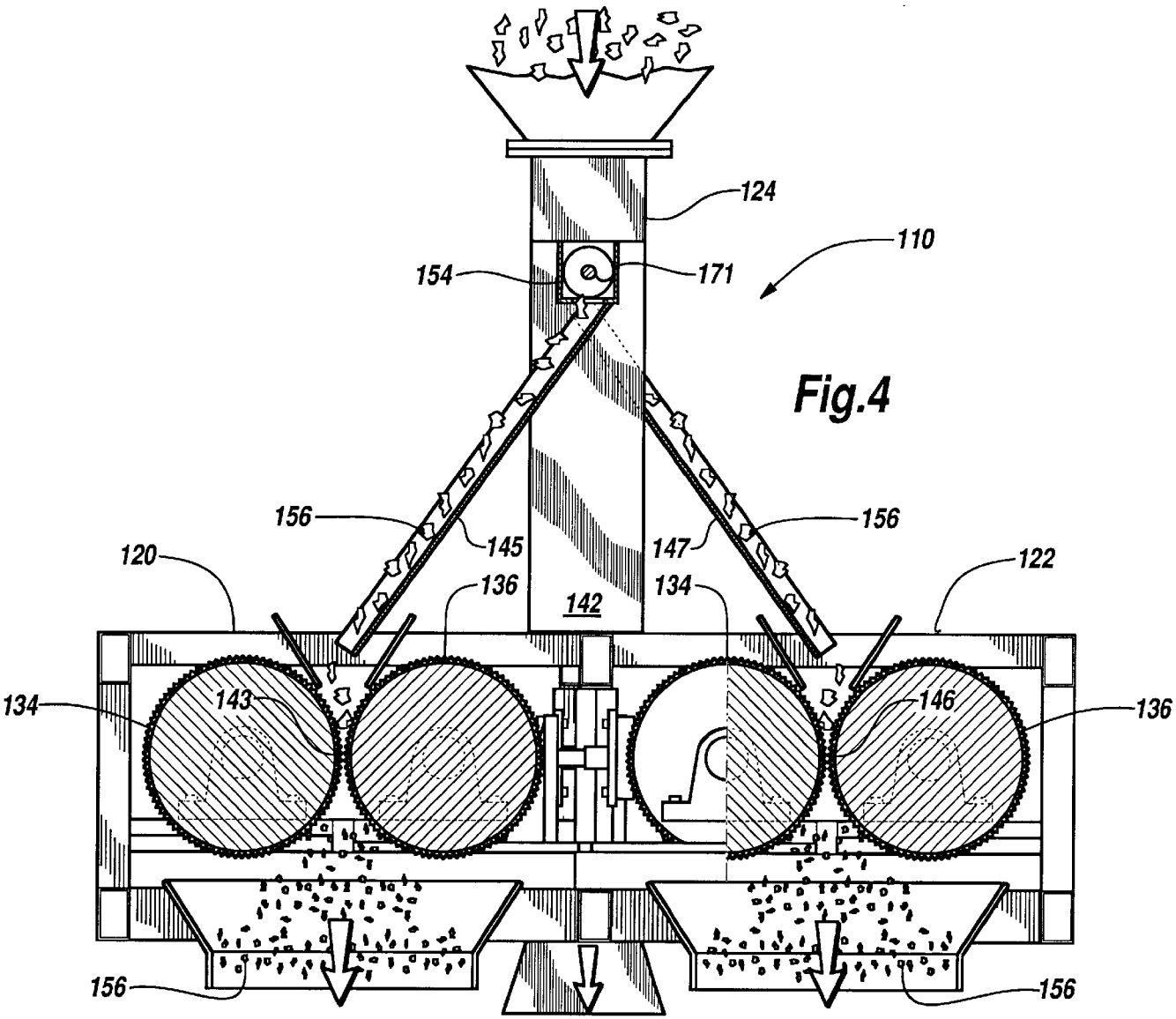
FIG. 4 is a cross-sectional view of the chip destructuring system of FIG. 3 taken along section line 4—4.

An alternative embodiment chip destructuring system 110 is shown in FIGS. 3 and 4. The alternative chip destructuring system 110 gives better access to all sides of two destructuring apparatuses 120 and 122. Combining the two chip destructuring devices 120, 122 with a chip distribution system 124 similar to the chip distribution system 24 shown in FIGS. 1 and 2, but with the difference that the chip distribution system 124 is offset from and spaced above the nip lines 143, 146.

Chips 156 to be processed by the system 110 are fed through a chip feed distribution system 124 which incorporates a distribution housing 154 mounted parallel to and spaced between and above the nip lines 143, 146 formed between the rolls 134, 136 of the chip destructuring devices 120, 122. The distribution housing 154 is located sufficiently above the nip lines 143, 146 so that slide chutes 145, 147 can move the chips 56 distributed by the augers 170, 171 to the nip lines 143, 146. Baffles (not shown) In the chip feed distribution system 124 allow the chips 156 to bypass the chip destructuring devices 120, 122 and pass through a bypass chute 142.

The slide chutes 145, 147 are positioned with vertical slopes greater than the angle of repose so that wood chips 156 will freely slide from the trapezoidal slot 190 to the nips between the rolls 134, 136. The angle of repose of a material is a characteristic of granular materials and depends on the material type and the distribution of particle sizes. The angle of repose of a particular material is found by measuring the angle the sides of a heap of the material makes with the horizontal. The angle of repose is the steepest angle which a particular material will assume when poured into a pile. Because the surfaces 137, 149 of the slide chutes 145, 147 are inclined at a steeper angle than the angle of repose of the wood chips 56, the chips will readily slide down the chutes 145, 147.

It should be understood that by vibrating the chutes 145, 147 the coefficient of friction of the surfaces 137, 149 may be lowered. This is because vibration prevents the development of static friction between the wood chips 156 and the surfaces 137, 149 which is substantially greater than the frictional forces due to the dynamic coefficient of friction.

It should be understood that for illustration purposes, a Rader Companies chip destructuring device similar to model number 40-150 is shown. Model 40-150 has rolls which are four feet long and which employ sixteen roll segments on each roll. However, the feed system 24 would typically be used with Rader's chip destructuring devices similar to model numbers 60-200 or 80-3000 which have rolls six and eight feet long respectively.

The angle of repose of a material can be measured in a number of ways. The so-called external angle of repose is the angle between a line of repose of loose material and a horizontal plane. A poured angle of repose is obtained when a pile of solid is formed; drained angle results when solids are drained from a bin. Typically, the drained angle of repose and the poured angle of repose are approximately the same, but for material with a wide size distribution, the drained angle will be greater than the poured angle. Other related angles are the angle of slide which is the angle of a plate on which a material will slide. For the chip conditioners, the important relationship between the wood chips and the lateral slides is that the material cascade or slide down the lateral climb. Therefore, the angle of repose is herein defined as that angle at which, dependent on the slide surface properties and whether the slide is subjected to vibration, the wood chips will readily move down the inclined surfaces 137, 149 defined by the slides 145, 147. As shown in FIG. 4, a typical inclination angle is slightly greater than forty-five degrees from the horizontal.

It is understood that the invention is not limited to the particular construction and arrangement of parts herein illustrated and described, but embraces such modified forms thereof as come within the scope of the following claims.

I claim:

1. A chip destructuring system comprising:

a first pair of opposed rolls having aggressive surfaces and mounted to form a first nip therebetween;

a second pair of opposed rolls having aggressive surfaces and mounted to form a second nip therebetween, the second pair of rolls being mounted adjacent to the first pair of rolls so a line defined by the first nip passes substantially through the second nip formed by the second pair of rolls;

a chip distribution system positioned to distribute chips to both nips, said system further comprising:

a motor driven shaft having a first right handed auger and a second left handed auger spaced from the first right handed auger:

a housing containing the shaft and being divided into three portions. a first portion containing the first right handed auger, a second portion containing a portion of the shaft between the first right handed auger and the second left handed auger. and a third portion containing the left handed auger:

a first baffle and a second baffle which extend upwardly from the housing and are pivotally mounted to the housing, wherein the first baffle is pivotal between a positioned extending into the second portion of the housing and a position separating the first portion of the housing from the second portion of the housing, and wherein the second baffle is pivotal between a position extending into the second portion of the housing and a position separating the third portion of the housing from the second portion of the housing.

2. The chip destructuring system of claim 1 wherein the housing has portions defining a wood chip receiving opening; the first housing portion extending over the first nip; the third housing portion extending over the second nip; and the second portion joining the first portion and the third portion, the second portion being spaced between the first pair of rolls and the second pair of rolls, wherein the chip receiving opening is defined by the second portion.

3. The chip destructuring system of claim 1 further comprising:

a chip bypass opening formed in the housing between and below the first baffle and the second baffle; and a bar positioned above the bypass opening and forming a flow splitter when the first baffle and second baffle are moved to engage the bar, the flow splitter for dividing a flow of wood chips between the right handed auger and the left handed auger.

4. The chip destructuring system of claim 3 wherein when the first baffle and the second baffle are positioned in a vertical position they allow wood chips to pass through the bypass opening.

5. A chip destructuring system comprising:

a first pair of opposed rolls having aggressive surfaces and mounted to form a first nip therebetween:

a second pair of opposed rolls having aggressive surfaces and mounted to form a second nip therebetween, the second pair of rolls being mounted adjacent to the first pair of rolls so a line defined by the first nip passes substantially through the second nip formed by the second pair of rolls:

a single means for distributing chips to both nips mounted over the first pair of rolls and the second pair of rolls:

wherein the means for distributing chips is a distribution housing comprising:

portions defining a wood chip receiving opening;

a first portion extending over the first nip;

a second portion extending over the second nip; and a third portion joining the first portion and the second portion, the third portion being spaced between the first pair of rolls and the second pair of rolls, wherein the chip receiving opening is defined by the third portion;

a shaft extending along the distribution housing, the shaft being mounted for rotation within the distribution housing;

a first shaft portion;

a right handed auger mounted around the first shaft portion and positioned over the first nip;

a second shaft portion; and a left handed auger mounted around the second shaft portion and positioned over the second nip so that rotation of the shaft causes wood chips fed to the augers to be moved towards the first nip and the second nip, further comprising a first trapezoidal slot formed in the distribution housing and positioned beneath the right handed auger, and a second trapezoidal slot formed in the distribution housing and positioned beneath the left handed auger, the first and second trapezoidal slots facilitating the even distribution of wood chips along the first and second nips.

6. A chip destructuring system comprising:

a first pair of opposed rolls having aggressive surfaces and forming a first destructuring device, the opposed rolls forming a first nip line therebetween and each roll having a diameter, wherein a distance is defined which is equal to the diameter of each roll added together;

a second pair of opposed rolls having aggressive surfaces and forming a second destructuring device, the second pair of opposed rolls forming a second nip line therebetween, and wherein the first and second nip lines are substantially parallel and spaced from one another in a direction perpendicular to the nip lines a distance which is more than the defined distance;

a wood chip distribution system mounted between the first and second pairs of opposed rolls, the chip distribution system having a first and a second linearly extending chip distributing opening which are arrayed along a single line;

a shaft forming part of the wood chip destructuring system, the shaft having a first portion on which a right handed auger is mounted and a second portion on which a left handed auger is mounted spaced from the right handed auger;

a planar surface extending from beneath the first linearly extending opening to a position above the first nip line; and a second planar surface extending from the second linearly extending opening to a position above the second nip line, wherein the first and second planar surfaces slope towards the first and second nip lines respectively at a slope greater than the angle of repose of wood chips.

7. A chip destructuring system comprising:

a first pair of opposed rolls having aggressive surfaces and forming a first destructuring apparatus, the opposed rolls forming a first nip line therebetween;

a second pair of opposed rolls having aggressive surfaces and forming a second destructuring apparatus, the second pair of opposed rolls forming a second nip line therebetween, and wherein the first and second nip lines are substantially colinear and spaced from one another in the direction in which the nip lines extend;

a wood chip distribution system mounted between the first and second pair of opposed rolls having a first and second linearly extending chip distributing opening;

a shaft forming part of the wood chip distribution system, the shaft having a first portion on which a right handed auger is mounted and space from the first portion a second portion on which a left handed auger mounted:

a planar surface extending from beneath the first linearly extending opening to a position above the first nip line; and a second planar surface extending from the second linearly extending opening to a position above the second nip line, wherein the first and second planar surfaces slope towards the first and second nip lines respectively at a slope greater than the angle of repose of wood chips.

8. The chip destructuring system of claim 7 further comprising:

a pair of spaced-apart baffles hingedly mounted between the left handed auger and the right handed auger;

a chip bypass opening formed in the distribution housing between and below the baffles; and a bar positioned above the bypass opening and forming a flow splitter with the baffles when the baffles are moved to engage the bar, the flow splitter dividing a flow of wood chips between the right handed auger and the left handed auger.

9. The chip destructuring apparatus of claim 8 wherein when the baffles are positioned in a vertical position they allow wood chips to pass through the bypass opening.

10. A chip destructuring system comprising:

a first pair of opposed rolls having aggressive surfaces and forming a first destructuring apparatus. the opposed rolls forming a first nip line therebetween;

a second pair of opposed rolls having aggressive surfaces and forming a second destructuring apparatus, the second pair of opposed rolls forming a second nip line therebetween, and wherein the first and second nip lines are substantially parallel and offset from each other;

a wood chip distribution system mounted between the first and second pair of opposed rolls having a first and second linearly extending chip distributing opening;

a planar surface extending from beneath the first linearly extending opening to a position above the first nip line;

a second planar surface extending from the second linearly extending opening to a position above the second nip line, wherein the first and second planar surfaces slope towards the first and second nip lines respectively at a slope greater than the angle of repose of wood chips;

wherein the wood chip distribution system comprises:

a distribution housing;

a shaft mounted for rotation and having a first portion with a right handed auger mounted thereon and positioned over the first nip. and a left handed auger mounted around a second portion of the shaft and positioned over the second nip, so that rotation of the shaft causes wood chips fed to the augers to be moved towards the first and second nips and, further comprising:

a first trapezoidal slot formed in the distribution housing and positioned beneath the right handed auger; and a second trapezoidal slot formed in the distribution housing and positioned beneath the left handed auger, the first and second trapezoidal slots facilitating the even distribution of wood chips along the first and second nips.

* * * * *